US005491323A

United States Patent [19]

Mori et al.

[11] Patent Number: 5,491,323

[45] Date of Patent: Feb. 13, 1996

[54] HIGH FREQUENCY HEATING APPARATUS FOR HEATING A MATERIAL AND A METHOD OF HEATING A MATERIAL BY HIGH FREQUENCY IRRADIATION

[75] Inventors: Fumiko Mori, Osaka; Haruo Matsushima, Yamatokoriyama, both of Japan

[73] Assignee: Matsushita Electric Industrial Co., Ltd., Osaka, Japan

[21] Appl. No.: 170,889

[22] Filed: Dec. 21, 1993

[30] Foreign Application Priority Data

| | | | |
|---|---|---|---|
| Dec. 21, 1992 | [JP] | Japan | 4-340041 |
| Feb. 10, 1993 | [JP] | Japan | 5-022314 |
| Aug. 10, 1993 | [JP] | Japan | 5-198131 |
| Sep. 8, 1993 | [JP] | Japan | 5-223297 |

[51] Int. Cl.[6] ..... H05B 6/68

[52] U.S. Cl. ..... 219/710; 219/712; 219/494; 99/325

[58] Field of Search ..... 219/710, 711, 219/712, 494, 510; 99/DIG. 14, 451, 325; 426/241, 243, 523

[56] References Cited

U.S. PATENT DOCUMENTS

| | | |
|---|---|---|
| 2,657,580 | 11/1953 | Schroeder . |
| 3,536,129 | 10/1970 | White . |
| 3,634,652 | 1/1972 | Shimizu et al. . |
| 4,453,066 | 6/1984 | Mori . |
| 4,785,824 | 11/1988 | Wickersheim et al. . |

FOREIGN PATENT DOCUMENTS

| | | |
|---|---|---|
| 52-17237 | 2/1977 | Japan . |
| 54-007641 | 1/1979 | Japan . |

OTHER PUBLICATIONS

Patent Abstracts of Japan, unexamined applications, M Field, vol. 7, No. 199 Sep. 3, 1983, The Patent Office Japanese Government, p. 117 M 240, JP-A-58-99 623 (Matsushita).

Patent Abstracts of Japan, unexamined applications, M Field, vol. 12, No. 302, Aug. 17, 1988, The Patent Office Japanese Government, p. 12 M 732; JP-A-63-75 419 (Matsushita).

Patent Abstracts of Japan, unexamined applications, M Field, vol. 7, No. 179, Aug. 9, 1983, The Patent Office Japanese Government, p. 148 M 234; JP-A-58-83 132 (Matsushita).

*Primary Examiner*—Philip H. Leung
*Attorney, Agent, or Firm*—Wenderoth, Lind & Ponack

[57] ABSTRACT

A method of heating food with microwaves, where in order to avoid uneven heating between the food surface and its interior, which is a problem peculiar to microwave heating, the heat conduction of the food interior is positively used, supplying necessary minimum energies while monitoring the surface temperature of the food, and heating food to the optimum temperature on both the surface of the food and in the interior of the food.

18 Claims, 17 Drawing Sheets

HIGH FREQUENCY HEATING APPARATUS FOR HEATING A MATERIAL AND A METHOD OF HEATING A MATERIAL BY HIGH FREQUENCY IRRADIATION

BACKGROUND OF THE INVENTION

The present invention generally relates to a microwave heating method and apparatus for effecting a vacuum cooking operation (sous vide) with high frequency heating.

The vacuum cooking operation cooks vacuum packed foods at a constant temperature between approximately 55° C. and approximately 95° C. using either boiling water or steam. It has following advantages. (A) The heat conduction is superior because of the vacuum. A uniform heating can be effected at a specific temperature which ensures the most delicious taste with respect to foods. (B) The permeation of seasonings is superior because of the vacuum. The seasoning can be effected using only small amounts of sugar and salt, thus being desirable from the health standpoint. (C) Food is vacuum packed so that the flavor is not diminished. (D) Food is heated at low temperatures so that lines, fibers and so on remain soft without becoming hardened. (E) The yield is considerably higher, because food is cooked at temperatures where water division of protein is not caused. (F) Foods can be preserved for approximately one week in cold storage so that the mass supply of foods for banquets at a hotel can be conveniently provided. Vacuum cooking was s invented in France and has spread quickly.

The humid environment of a kitchen where hot water of 60° C. through 95° C. is kept is not favorable as judged easily from the humid environment within the bath chamber in which the hot water temperature is 42° C. through 43° C. The environment has a risk of being dangerous enough to cause burns. Therefore, improvements in the environment are strongly desired. A reduction in the high fuel expenditure needed to maintain the high temperatures is also desired. Similar problems arise in the case of steam ovens.

As a solution to the above problems, the use of a high frequency heating apparatus such as electronic range or the like has been considered. It is extremely difficult to effect a solution using a conventional apparatus, because the final temperature accuracy demanded during the vacuum cooking operation is approximately 1° C. Although various methods are used in France, the results are said to be failures. The final temperature accuracy of foods in the conventional apparatus will be approximately 20° C. at its highest.

The uniform heating methods used by the conventional apparatus can be chiefly classified into four methods.

Firstly, one tries to make the electromagnetic wave distribution uniform. Various ideas represented by stirrer blades or turntables have been disclosed. The trials are too numerous to mention.

Secondly, a method which is used widely in the conventional cooking operation using fire is used as is. Wave concentration onto one portion is prevented or a high temperature portion or an excessively heated portion are cooled so as to make them uniform. Aluminum foil is used as the wave concentration prevention so as to effect a wave shielding operation. Defrosting the frozen foods in cold air is introduced as a cooling method in U.S. Pat. No. 3,536,129.

Thirdly, what is generally called weight-defrosting or weight-cooking is widely used. A heating operation is effected with the irradiation power and the irradiation time of optimum waves being set in accordance with the food weight; foods are left without the application of microwaves for an optimum standing time and the temperature becomes uniform due to the thermal conduction of the food interior. The U.S. Pat. No. 4,453,066 is one example of such a method.

Fourthly, the temperature of the food is detected so as to control the application of microwaves. There are patents such as the U.S. Pat. No. 3,634,652 (foods are retained at a given temperature or lower using a sensor), and the U.S. Pat. No. 4,785,824 (optical fiber thermometer is used) in addition to the U.S. Pat. No. 2,657,580 (multirange thermometer). Japanese Laid-Open Patent Publication No. 52-17237 discloses a plurality of locations in food in which the temperature is detected; the microwave output is lowered at a time when the set temperature has been reached at one location, and the heating is completed at a time when another has reached the set temperature.

Japanese Laid-Open Patent Publication No, 54-7641 discloses a method of estimating the internal temperature from the food surface temperature; the microwave irradiation is stopped when the surface temperature has reached 5° C. during the defrosting of the frozen food; microwaves are applied again at a time when the surface temperature is as low as 0° C., and differentiation values in time change from 5° C. to 0° C. are detected).

But it is impossible to have the temperature of each portion of the food be within several degrees C or lower, although it is not said that a 1° C. or lower difference is necessary, with respect to the desired final temperature at the completion of the heating by these methods.

If, for example, the temperatures of each portion of the food can be measured correctly heating can be easily realized by an advanced controlling method using computers in an estimation controlling operation or the like. However, only one portion becomes 65° C. if a heating operation is effected to, for example, 65° C., or the other portion remains cold without being heated (described later in detail).

Although relatively good results are obtained even in a method of gradually reducing the application of microwaves to be used in defrosting operation, the latent heat of 80 calories at 0° C. becoming a buffer during the defrosting operation. The difference between the desired temperature and the actual final temperature is large and also, the temperature difference between different portions of the food is also large.

In the vacuum cooking operation, a heating operation is effected with, for example, a final temperature of 65° C. as a target, and variations of +10° C. or −10° C. occur, and thus the final temperature is between 55° C. and 75° C.

SUMMARY OF THE INVENTION

Accordingly, the present invention has been developed with a view to substantially eliminating the above discussed drawbacks inherent in the prior art and has for its essential object to provide an improved microwave heating method and apparatus.

Another important object of the present invention is to reduce the temperature difference between a desired final temperature and each portion of a food by 1° C. and by approximately several °C. at maximum.

In accomplishing these and other objects, the present invention comprises: a high frequency heating apparatus for heating a material, this apparatus comprising: a heating chamber for accommodating this material; a high frequency wave irradiation source for irradiating high frequency waves into this heating chamber; a desired temperature setter for setting a desired temperature to which this material is to be heated; a threshold temperature setter for setting a threshold temperature which is lower than this desired temperature; a surface temperature detector for detecting a temperatures of a surface portion of this material; a center temperature detector for detecting a temperature of a center portion of this material; a difference temperature detector for detecting a difference between this surface temperature and this center temperature and for producing a difference temperature; and a controller for controlling this irradiation source such that this irradiation source irradiates high frequency waves when the following three conditions are satisfied; (i) this difference temperature is within a predetermined set range; (ii) this surface temperature is less than this desired temperature; and (iii) this center temperature is less than this threshold temperature. takes the following means.

The present invention may also comprise: a high frequency heating method for heating a material by a high frequency wave irradiation source, comprising the steps of: (a) detecting a temperature of a surface portion of said material; (b) detecting a temperature of a center portion of said material; (c) detecting a difference between said surface temperature and said center temperature and producing a difference temperature; and (d) irradiating high frequency waves by said irradiation source when the following three conditions are satisfied: (i) said difference temperature is within a predetermined set range; (ii) said surface temperature is less than a desired temperature to which said material is to be heated; and (iii) said center temperature is less than a threshold temperature which is lower than said desired temperature.

The present invention may comprise: a high frequency heating apparatus for heating a material, said apparatus comprising: a heating chamber for accommodating said material; a high frequency wave irradiation source for irradiating high frequency waves into said heating chamber; a temperature detector for detecting a current temperature of said material; a weight setter for setting a weight W of said material; a desired temperature setter for setting a desired temperature to which said material is to be heated and for obtaining a rise temperature $\theta$ which is a difference between said current temperature before heating and said desired temperature; a heating time setter for setting a desired total heating time $\tau$; a total cumulated power calculator for calculating, based on said weight and said rise temperature, a total cumulated power Q necessary to heat said material up to said desired temperature; an irradiation source controller for controlling said irradiation source such that a cumulated power q from said irradiation source increases exponentially until said cumulated power reaches said total cumulated power.

Lastly, the present invention may also comprise: A high frequency heating method for heating a material by a high frequency wave irradiation source, comprising the steps of: (a) detecting a current temperature of said material; (b) detecting a weight W of said material; (c) setting a desired temperature to which said material is to be heated and for obtaining a rise temperature $\theta$ which is a difference between said current temperature before heating and said desired temperature; (d) setting a desired total heating time $\tau$; (e) calculating, based on said weight and said rise temperature, a total cumulated power Q necessary to heat said material up to said desired temperature; and (f) controlling said irradiation source such that a cumulated power q from said irradiation source increases exponentially until said cumulated power reaches said total cumulated power.

BRIEF DESCRIPTION OF THE DRAWINGS

These and other objects and features of the present invention will become apparent from the following description of the preferred embodiment thereof with reference to the accompanying drawings, in which.

DETAILED DESCRIPTION OF THE INVENTION

Figure 1A:
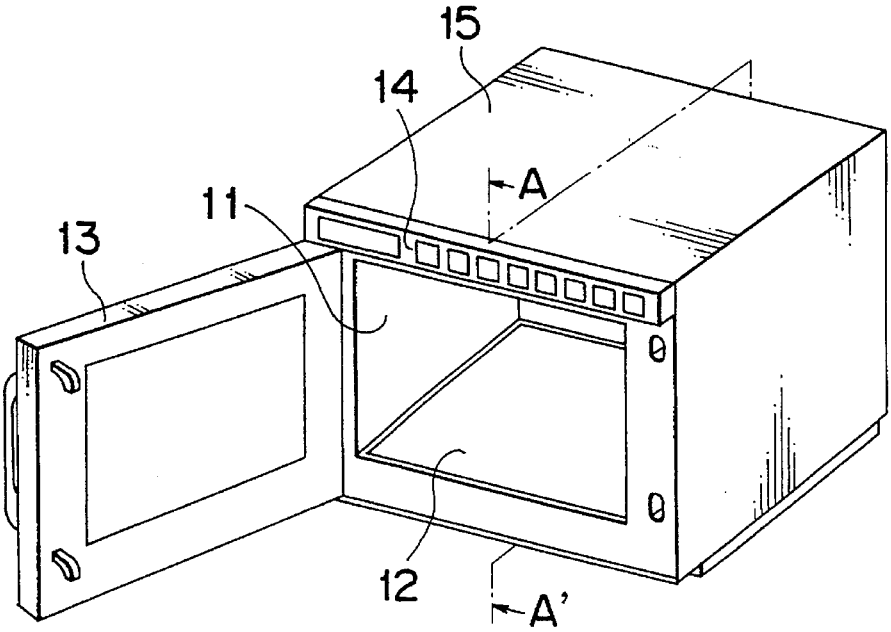
FIG. 1*a* and FIG. 1*b* are perspective view of a high frequency heating apparatus of the present invention and a sectional view taken along a line A—A' thereof.

Before the description of the present invention proceeds, it is to be noted that like parts are designated by like reference numerals throughout the accompanying drawings.

Figure 1B:
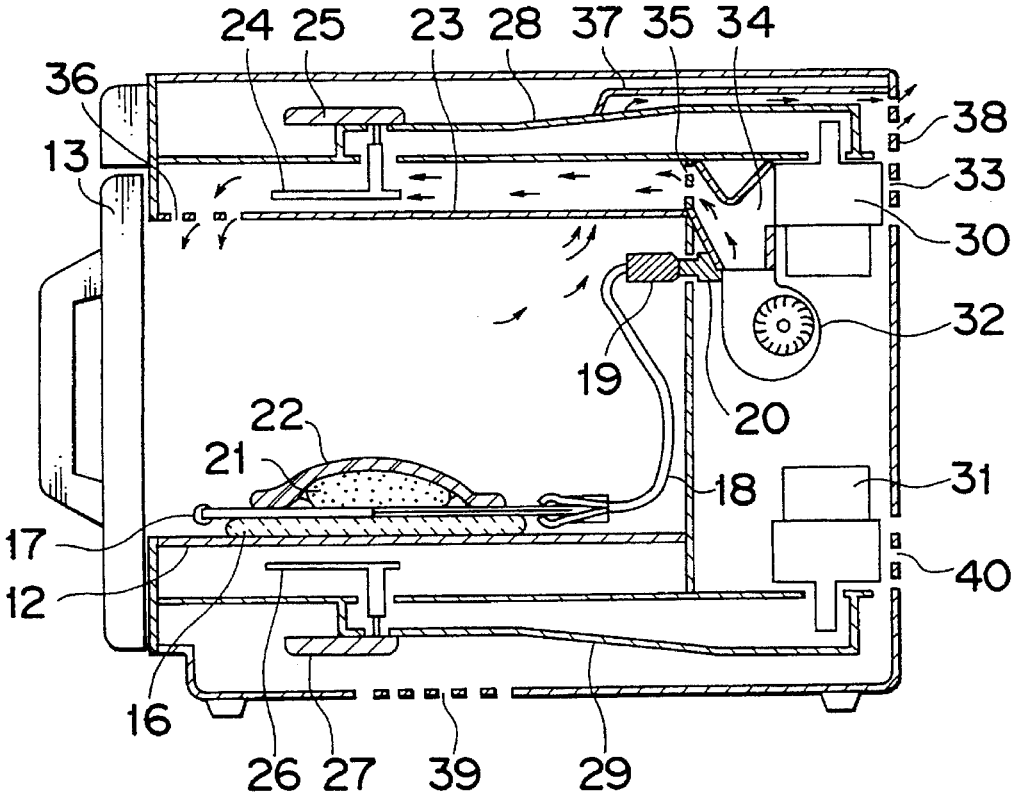

FIG. 1*a* is a perspective view showing an outer appearance of a high frequency heating apparatus of the present invention and FIG. 1*b* is a sectional view taken along a line A—A' thereof. The frequency wave heating apparatus is composed of a stainless mesh heating chamber 11, a glass food placement board 12 fixed on the lower portion, a door 13 for closing a heating chamber opening, an operating portion 14 provided on the upper portion of the door, and an outer box 15.

An oil mat 16 is placed on the food placement board 12 and a wire rack 17 is placed on it. A multicore shielded wire 18, a metallic plug 19 provided on its tip, and a metallic connector 20 fixed onto a rear wall face of the heating chamber are also shown. The wire rack will be described later in detail. The plug 19 and the connector 20 are chosen to fit each other. A metallic plug and connector for RS-232C use, which are widely used in personal computers at present, are used.

The heated food 21, for example, a flat tongue shaped flounder, is placed on the wire rack 17. An oil mat 22 is further placed on it. A resin stirrer cover 23 is fixed in the upper portion of the heating chamber. An antenna 24 and a motor 25 for the rotation thereof are disposed in the upper portion. Likewise, an antenna 26 and a motor 27 for the rotation thereof are disposed under the food placement board 12. A waveguide 28 is provided on the top face of the heating chamber and a waveguide 29 is provided on the bottom face. A magnetron 30 is provided at the end of the waveguide 28 and a magnetron 31 is provided at the end of the waveguide 29. Each waveguide connects the magnetron to an antenna.

A fan motor 32 is provided to air cool the magnetron 30. One portion of the cooling air passes through the magnetron 30 and is thereafter exhausted from a perforated exhaust group 33. The air exhausted through an air guide 34, a perforation group 35 provided in the rear face wall of the heating chamber, a perforation group 36 provided close to the door of the stirrer cover, an exhaust perforation group, an exhaust guide 37 provided in the top face wall of the heating chamber not described in FIG. 1 and a perforation group 38 provided in the rear face walls of the heating chamber. Outside air is inputted from the perforation group 39 provided in the bottom walls of the outer box and moved by the fan motor 32. A fan motor (not shown) for cooling the magnetron 31 is also provided so that air is exhausted from the exhaust perforation group 40 provided in the reverse face wall of the outer box.

Figure 2A:
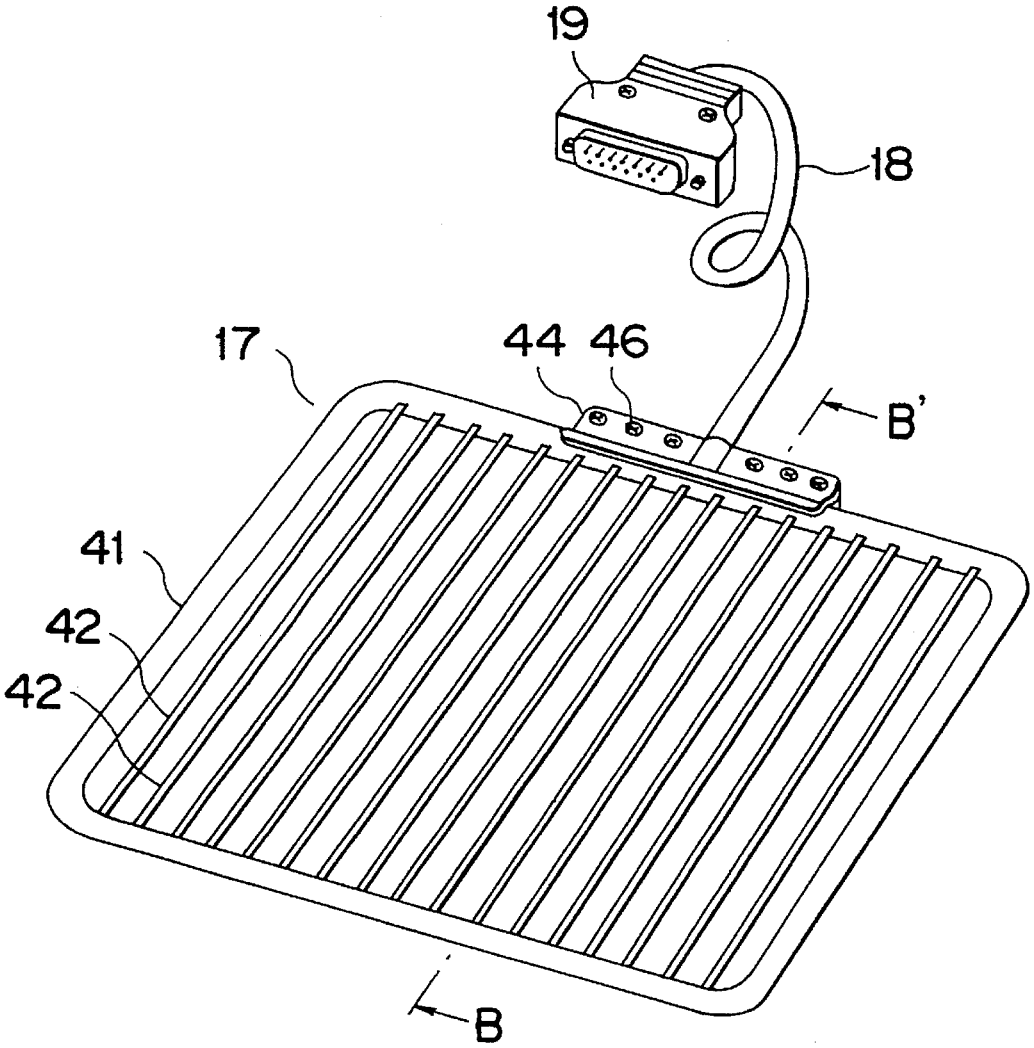
FIG. 2*a* and FIG. 2*b* are a perspective view of a wire rack of the present invention and a sectional view taken along a line B—B' thereof.
Figure 2B:
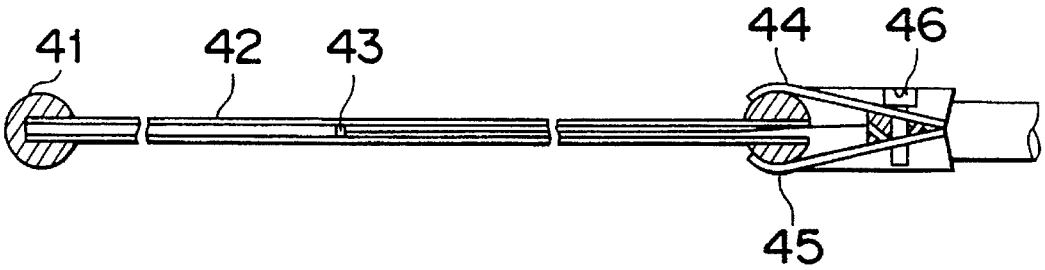

FIG. 2*a* is a perspective view of a wire rack 17, and FIG. 2*b* is a sectional view taken along a line B—B' thereof. The wire rack is composed of a square shaped frame 41 of a metallic round rod, a hollow circular metallic rod body 42 fixedly inserted into a non-perforated hole which is opened from behind into the front side of the frame and a through hole which is opened longitudinally through to the rear side of the frame, a thermistor 43 inserted into the interior, a pair of metal mounting fittings 44 and 45 fixed in a condition for grasping the rear side of the frame, a group of screws 46 for fixing them, and the multicore shielded wire 18 and the metallic plug 19.

The rod shaped body 42 is a metallic tube, approximately 1.3 mm in inside diameter, 0.18 in thickness, which is made by the same method as that of, for example, an injection needle. The rod shaped body is fixedly mounted on the frame 41. The rod shaped body together with the frame is nickel-plated. A thermistor 43 is inserted into the tube. Two lead wires are insulated in a range positioned within at least the rod shaped body 42 and are electrically connected to one core wire of the multicore shielded wire 18 within a space of a triangle formed by the frame 41, and the pair of metal fittings 44 and 45.

A concave portion is provided in the center of the metal fittings 44 and 45. In this portion, a metal housing of the multicore shielded wire is grasped so as to effect the electric connection at the same time. The metallic plug 19 is also electrically connected to the metallic housing of the shielding wire. The thermistor 43, and its lead wires and so on are electrostatically shielded by the rod shaped body 42, the metal fittings 44 and 45, the metal housing of the shielding wire and the metal plug. In the present embodiment, seven thermistors 43 are used. They are positioned near the center of the rods, which are the central seven rods of the seventeen rod shaped bodies shown in FIG. 2*a*.

Figure 3:
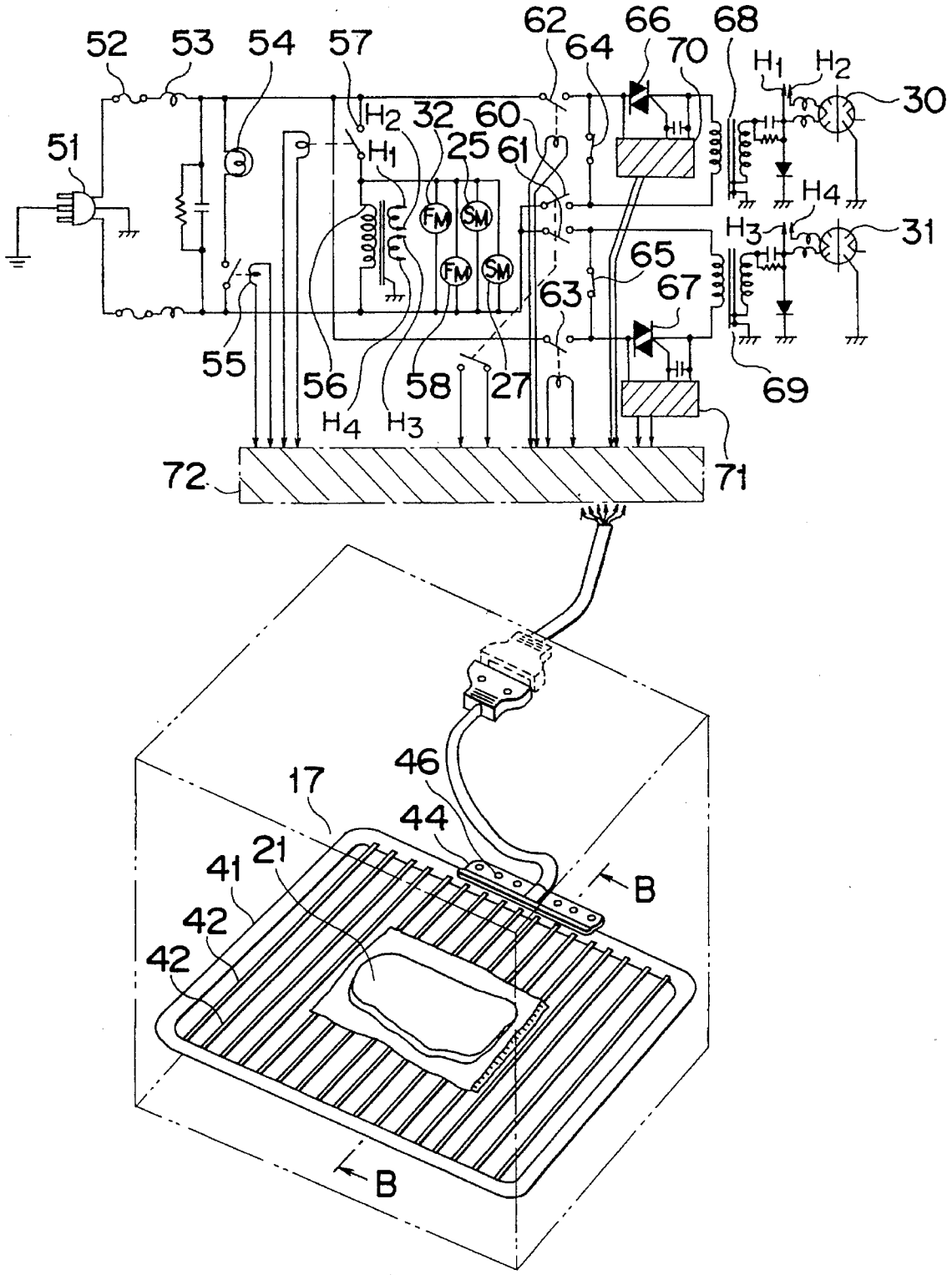
FIG. 3 is a circuit diagram of a high frequency heating apparatus of the present invention.

FIG. 3 is a circuit diagram, in the present embodiment, showing the combination of the wire rack 17 and the heated food 21 placed on it, and the electrical signals. A lamp 54 for illumination of the heating chamber and an ON-OFF relay 55 are connected through a fuse 52 and a coil 53 used as a noise filter to a power plug 51. A heater transformer 56 for the magnetrons and its ON-OFF relay are shown. Motors 25 and 27 for antenna rotation illustrated in FIG. 1 are connected in parallel to the heater transformer along with a fan motor 32 for magnetron cooling and a fan motor 58 not illustrated in FIG. 1. Switches 60 and 61 interlocked with the opening and closing of the door are connected in respective branch paths with main relays 62 and 63. Short switches 64 and 65 are switched. Triode AC switches (Triacs) 66 and 67 are shown. Further, high-voltage transformers 68 and 69 are shown. Magnetrons 30 and 31 are each connected through a capacitor and a diode on the secondary side of the respective high voltage transformer. Trigger circuits 70 and 71 are connected to the gates of the triode AC switches and are also connected to the controller circuit 72. The coils of all of the above described relays 55, 57, 62 and 63 are connected to the controller circuit 72, likewise.

Figure 4:
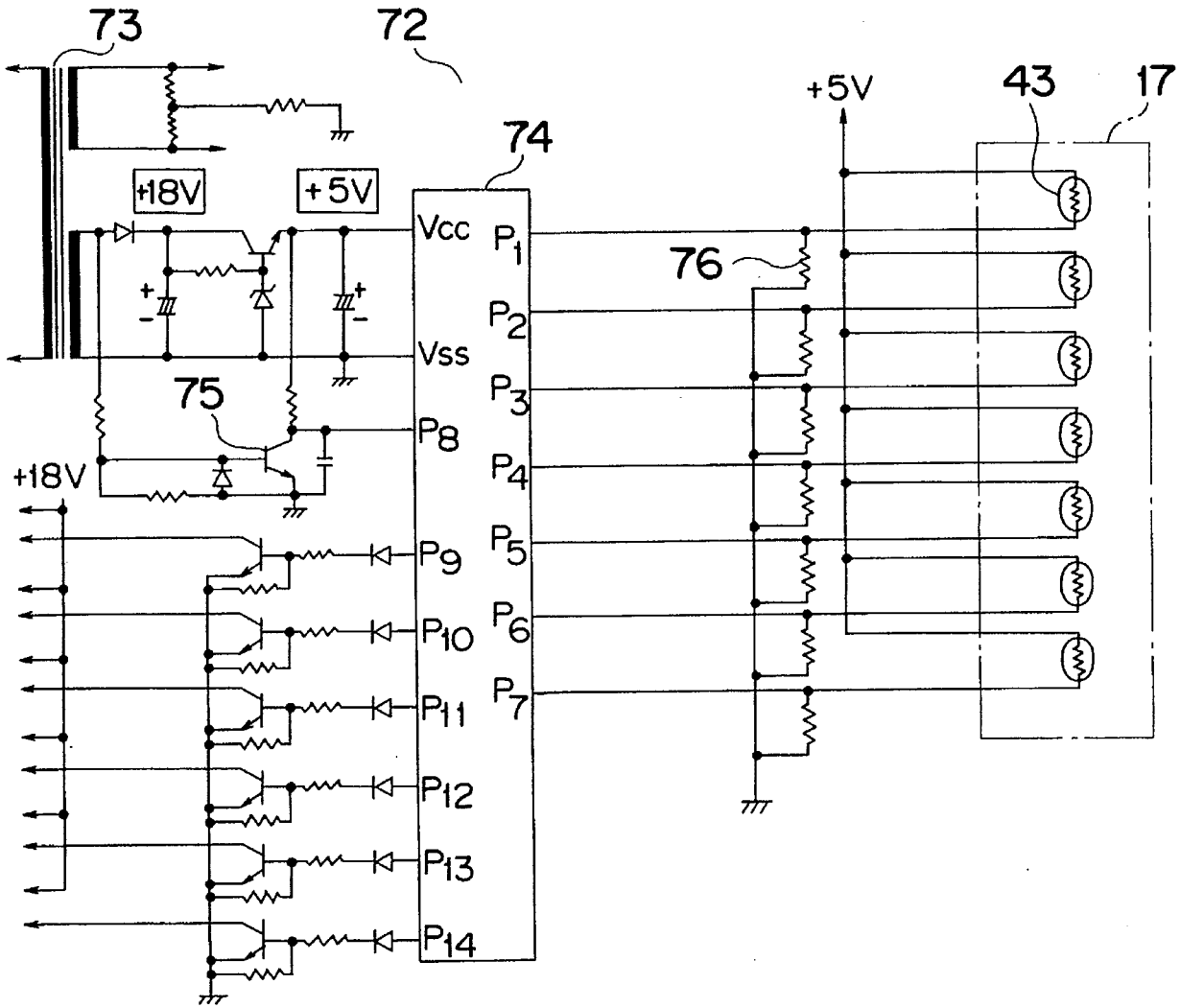
FIG. 4 is a circuit diagram of the control circuit of the high frequency heating apparatus of the present invention.

FIG. 4 is a circuit diagram of controller circuit 72. The primary side of the transformer 73 is connected to the coil 53 of FIG. 3. The voltage on the secondary side is rectified and smoothed so as to generate 18V DC and a stabilized 5V DC. The 5V DC is supplied between the VCC and VSS terminals of the microprocessor 74. The voltage waveform before the rectification on the secondary side of the transformer 73 is shaped by the transistor 75 and is inputted to one terminal (it is referred to as P8) of the microprocessor 74. The above described seven thermistors 43 are each connected in series with a respective fixed resistance 76 to +5V DC. The junctions of the fixed resistances and their respective thermistors are respectively connected to A / D conversion input terminals P1 to P7 of the microprocessor 74. The microprocessor 74 is connected to the trigger circuits 70 and 71 of the respective relays 55, 57, 62, 63 and the triode AC switches 66 and 67 and to the relays 55, 57, 62, and 63 illustrated in FIG. 3. Other types of inputs and outputs are connected to the microprocessor 74. They have all been omitted because they are irrelevant to the summary of the present invention.

Figure 5A:
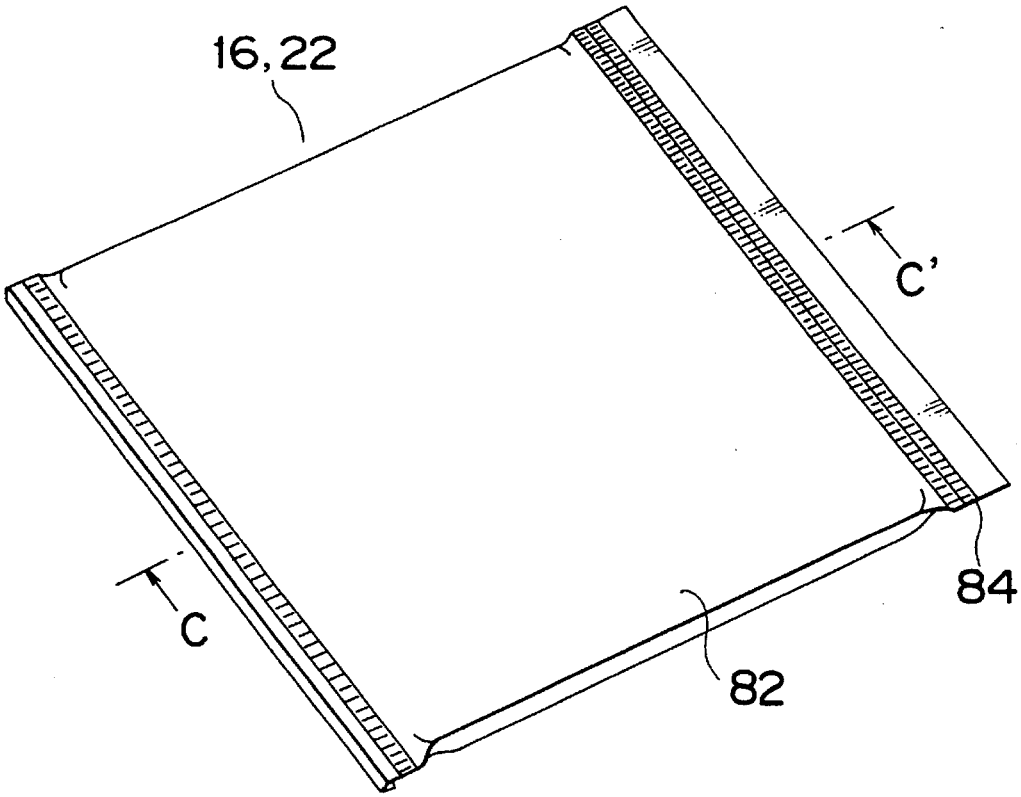
FIG. 5*a* and FIG. 5*b* are a perspective view of a liquid mat of the present invention and a sectional view taken along a line C—C' thereof.
Figure 5B:
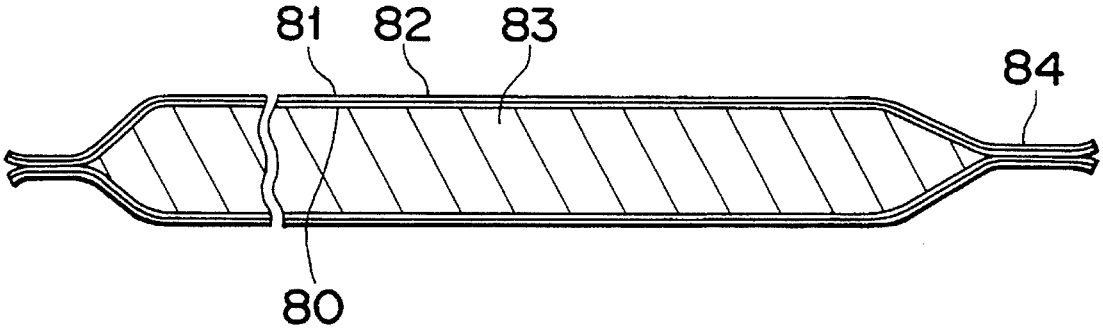

FIG. 5*a* is a perspective view of an oil mat 16 or 22, and FIG. 5*b* is a sectional view taken along a line of C—C' thereof. Each mat is a square type bag shaped container 82 of a thin flexible resin film composed of an inside polyethylene layer 80 having a thickness of approximately 50 microns and an outside nylon layer 81 having a thickness of approximately 20 microns. The square bag shaped container has edible oil 83 such as salad oil or the like therein and has an entrance portion 84 thermally sealed after the container is filled.

Figure 6:
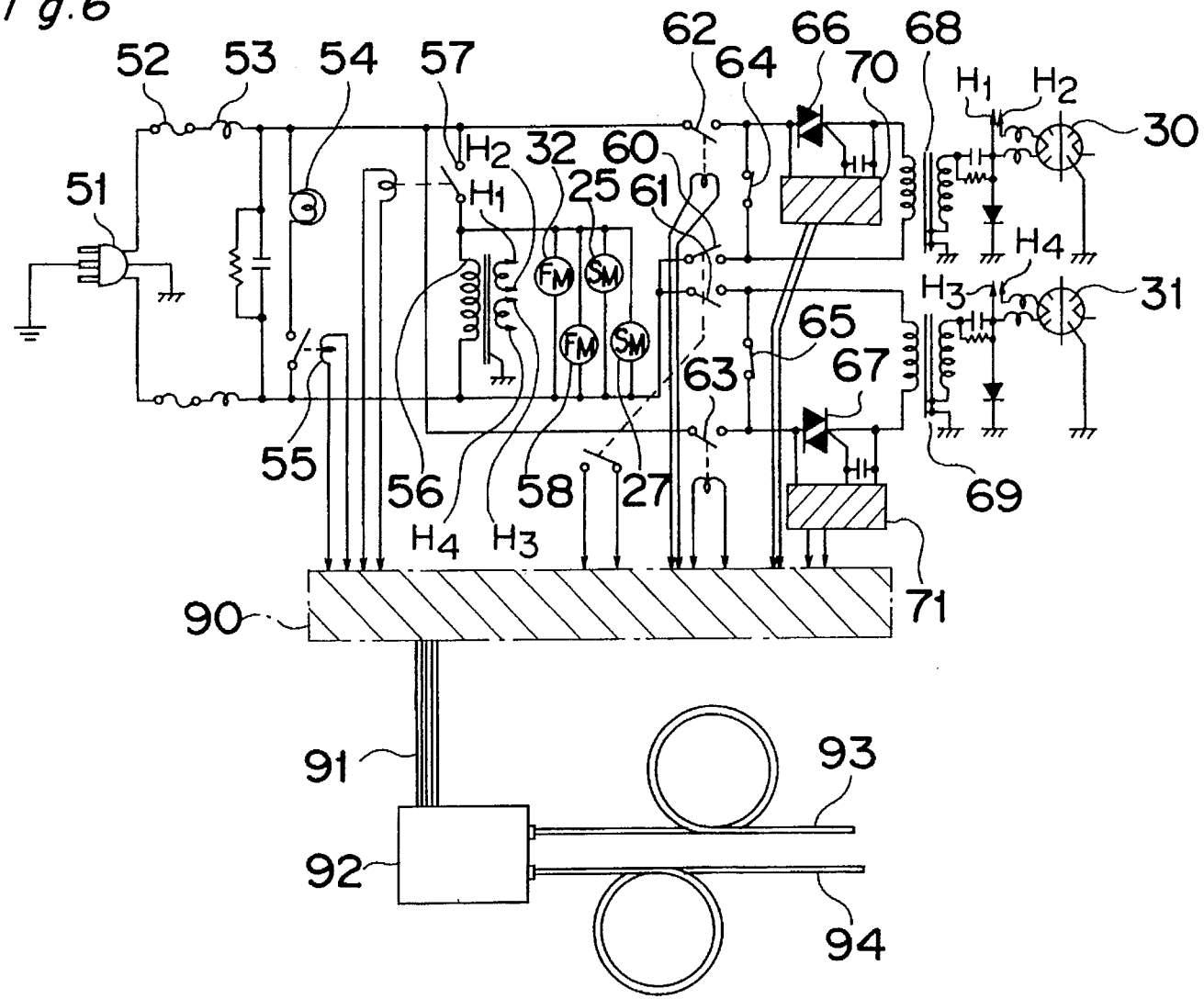
FIG. 6 is a circuit diagram in accordance with another embodiment of the present invention.

FIG. 6 is a circuit diagram in accordance with another embodiment which corresponds to the above described FIG. 3. The difference between FIG. 6 and FIG. 3 is that a personal computer 90 is used instead of the controller circuit 72 and an optical fiber thermometer 92 is connected through an RS-232C cable 91 from the personal computer 90. Optical fiber type temperature sensors 93 and 94 are connected to the thermometer 92. The two sensors 93 and 94 are guided into a heating chamber through orifices opened in the side wall of the above described heating chamber 11 and are inserted into the heated food 21 (not shown). For example, a notebook type personal computer PC-9801NS / T manufactured by NEC has been used. A specific notebook station and input and output boards such as MM-86 and PI016I, manufactured by MSE, have been used. A model 755 manufactured by Lackstron has been used as the optical fiber thermometer 92.

Figure 7:
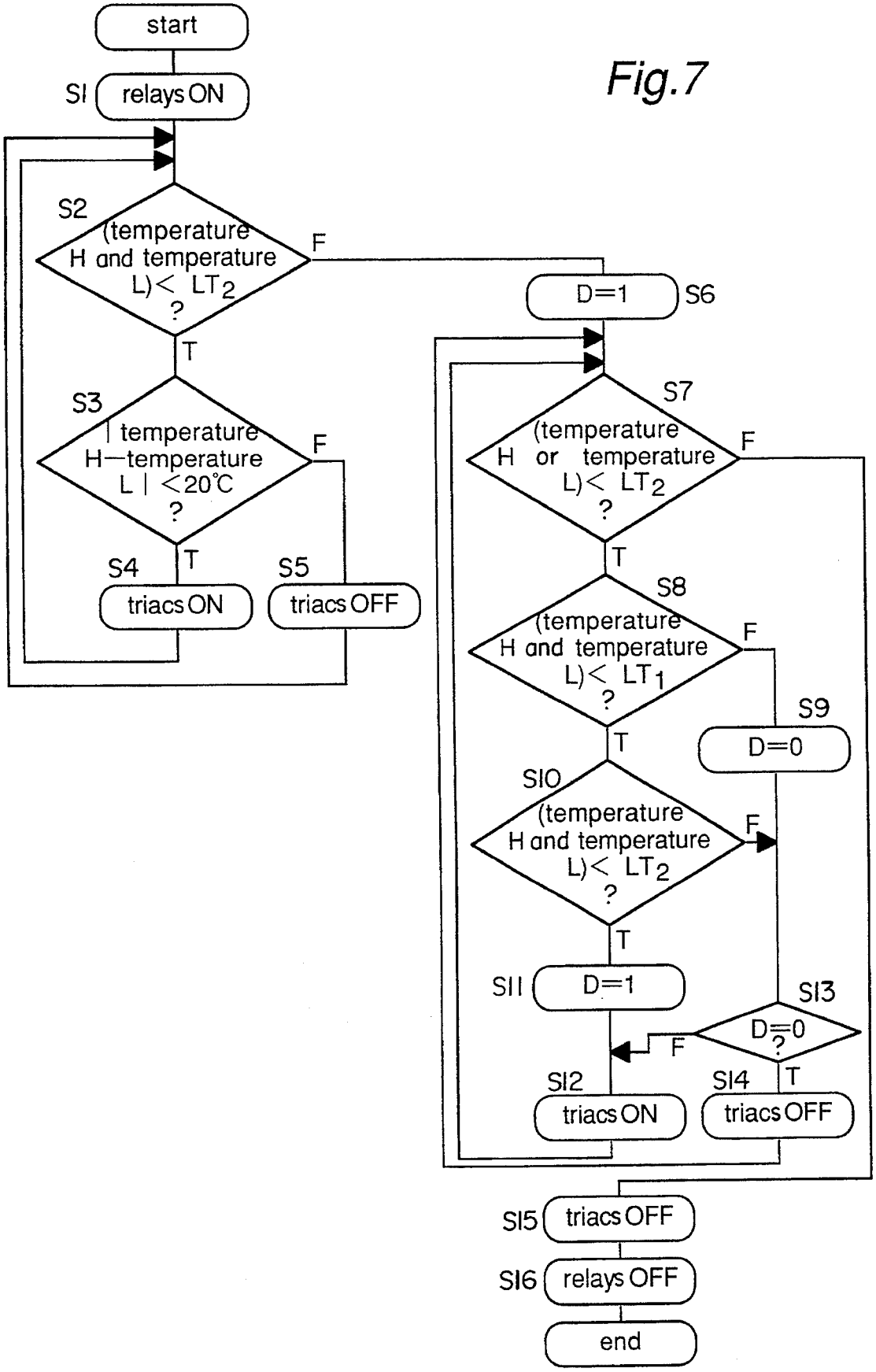
FIG. 7 is a flowchart in accordance with another embodiment of the present invention.

FIG. 7 is a flowchart of a control program to be used by the personal computer in the embodiment having the electric circuit of FIG. 6. A first temperature sensor 93 of the optical fiber thermometer is inserted into a portion where the heated food becomes highest in temperature, generally into the surface of the heated food. The highest temperature is assumed to be H. A second temperature sensor 94 is inserted into a portion where the temperature becomes lowest in temperature, generally into the center and its vicinity of the heated food. The lowest temperatures is assumed to be L. In order to know the highest and lowest temperature portions in advance, properly heat the food of the same shape and the temperature of each portion has only to be checked.

The desired final temperature $LT_1$ of the heated food and a temperature $LT_2$ which is lower than the desired temperature $LT_1$ by1° C. or by several °C. are input into the personal computer and stored. When a start key is depressed in step S1, all of the relays (55, 57, 62 and 63) are turned on. In step S2, a determination is made as to whether both the temperature H and the temperature L are both lower than $LT_2$. When both temperature H and temperature L are lower than $LT_2$, the program advances to step S3. Reference character T in FIG. 7 stands for True and means that the proposition within the box is correct. When the proposition is wrong, the program advances to step S6. A determination is made in step S3 as to whether the difference between the temperature H and the temperature L is, for example, less than 20° C. When the difference is less than 20° C., the program advances to step S4 so as to turn on the two triode AC switches 66 and 67.

The program then returns upwards so as to again effect two temperature checks in steps S2 and S3. When the temperature difference is 20° C. or more, the program advances to step S5 so as to turn off the triode AC switches. The ON-OFF operation of the triode AC switches are repeated in this manner until the temperature H reaches the temperature $LT_2$. At that time, the program advances to steps S6–S16.

First, a D flag is set at 1 in step S6. Then, a determination is made in step S7 as to whether either the temperature H or the temperature L is lower than $LT_2$. If either of the temperatures L or H is found to be lower than $LT_2$ in step S7, then the program advances to Step S8. Then, a determination is made in step S8 as to whether the temperatures H and L are lower than $LT_1$. When both temperatures H and L are lower than $LT_1$, the program advances to step S10. Then, a determination is made as to whether both the temperatures H and L are lower than $LT_2$. If not, the program advances to step S13 because the temperature H has been reached. In step S13 a determination is made as to whether the D flag is set at 0. If the D flag has been set to 1, the program advances to step S12 so as to turn on the triode AC switches.

Subsequently, the program returns upwards again so as to effect the three temperature checks of steps S7, S8, and S10. When the temperature H reaches a $LT_1$ a determination in step S8, the program advances to step S9 so as to set the D flag at 0. The program then advances to step S13 so as to determine if the D flag is set at 0 and if so, the program advances to step S14 so as to turn off the triode AC switches. The program then upwards again and effects the three temperature checks of steps S7, S8, and S10. Since the D flag remains 0 if the temperature H is $LT_2$ or more, the triode AC switches remains off. When the temperature H becomes lower than $LT_2$2, as determined in step S10, the program advances to step S11 where the D flag is set to 1.

While the two point control of the temperature H between the temperatures $LT_1$ and $LT_2$ continues, not only the temperature H, but also the temperature L reaches $LT_2$. In other words, $H \geqq LT_2$ and $L \geqq LT_2$. The program advances to step S15 so as to turn off the triode AC switches, and so as to turn off all of the relays in step S16 so as to complete the heating operation.

Figure 8:
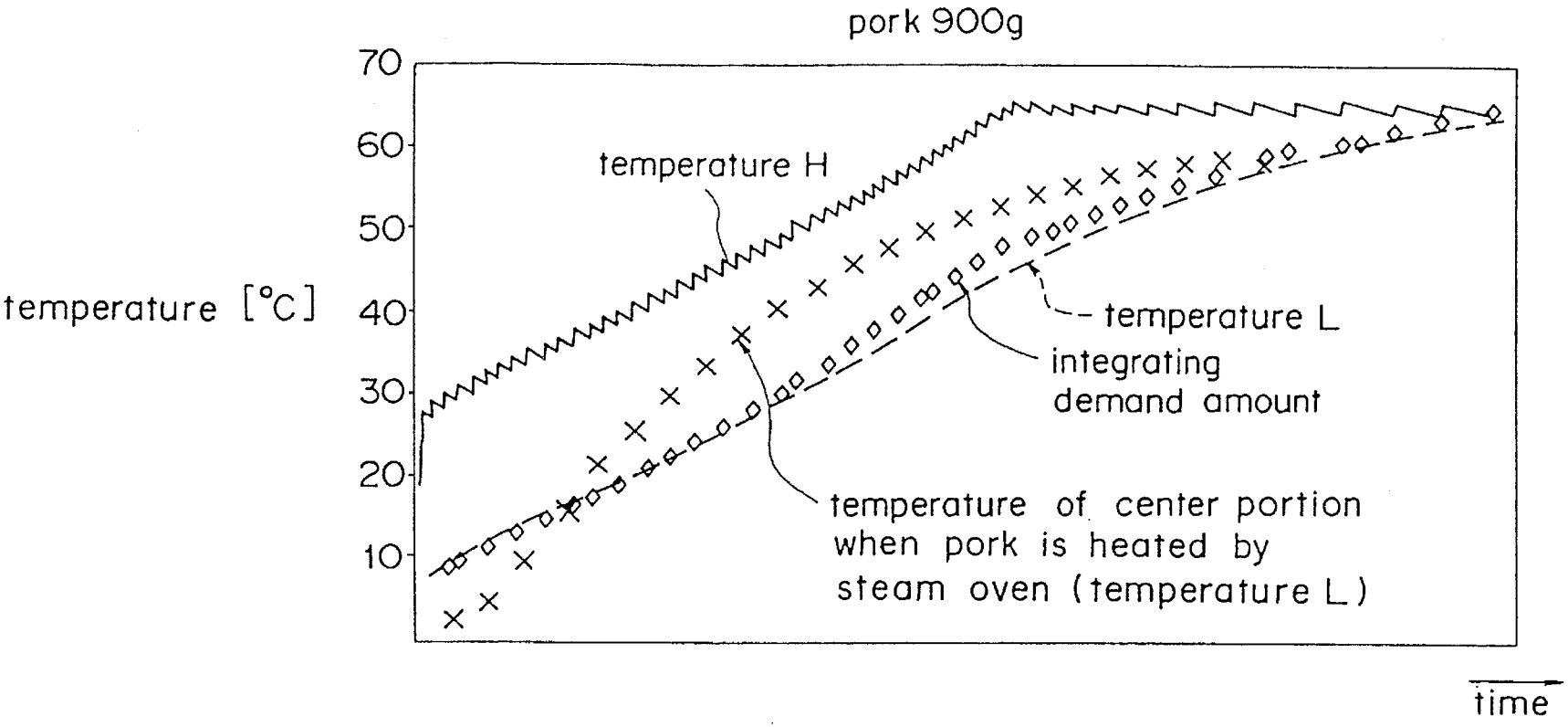
FIG. 8 is a view showing the temperature rise of a food heated by the high frequency heating apparatus of the present invention.

The operation of the embodiment shown in FIGS. 6 and 7 is as follows. FIG. 8 is a graph showing the relationship between time and temperature in a case where pork of approximately 900 grams frozen to approximately 0° C. through 5° C. is heated to a desired final temperature of 65° C. The graph shows the results where 65° C. is inputted as a desired final temperature $LT_1$, 64° C. is inputted as its lower temperature $LT_2$, and the pork is heated. A plate shaped oil mat which is approximately 1 cm in thickness is used. 500 grams of salad oil are is sealed into a bag which is approximately 23 cm in width, approximately 30 cm in length, and 0.1mm in film thickness. Two bags are used to surround the pork in a sandwich shape from above and below.

The heating time is two hours and thirty minutes. An integrating power value measured on the primary side of the transformers 68 and 69 is 136 watt hours, the temperature of respective portions of the pork is between 64° C. through 66° C. It is within the difference 1° C. or lower with respect to the final (desired) temperature of 65° C.

An optical fiber thermometer can measure the temperatures even in the high frequency irradiation environment. Relatively correct temperatures can be measured. The measured system has reduced turbulence. Namely, only the inserted portion thereof is not excessively heated by the insertion thereof into the food. It is considered that a uniform heating operation can be easily realized by the high frequency waves within 1° C. in temperature difference of each portion of the heated food by the combination of the optical fiber thermometer and the control art as described in the conventional art. Actually it cannot be realized.

Figure 9:
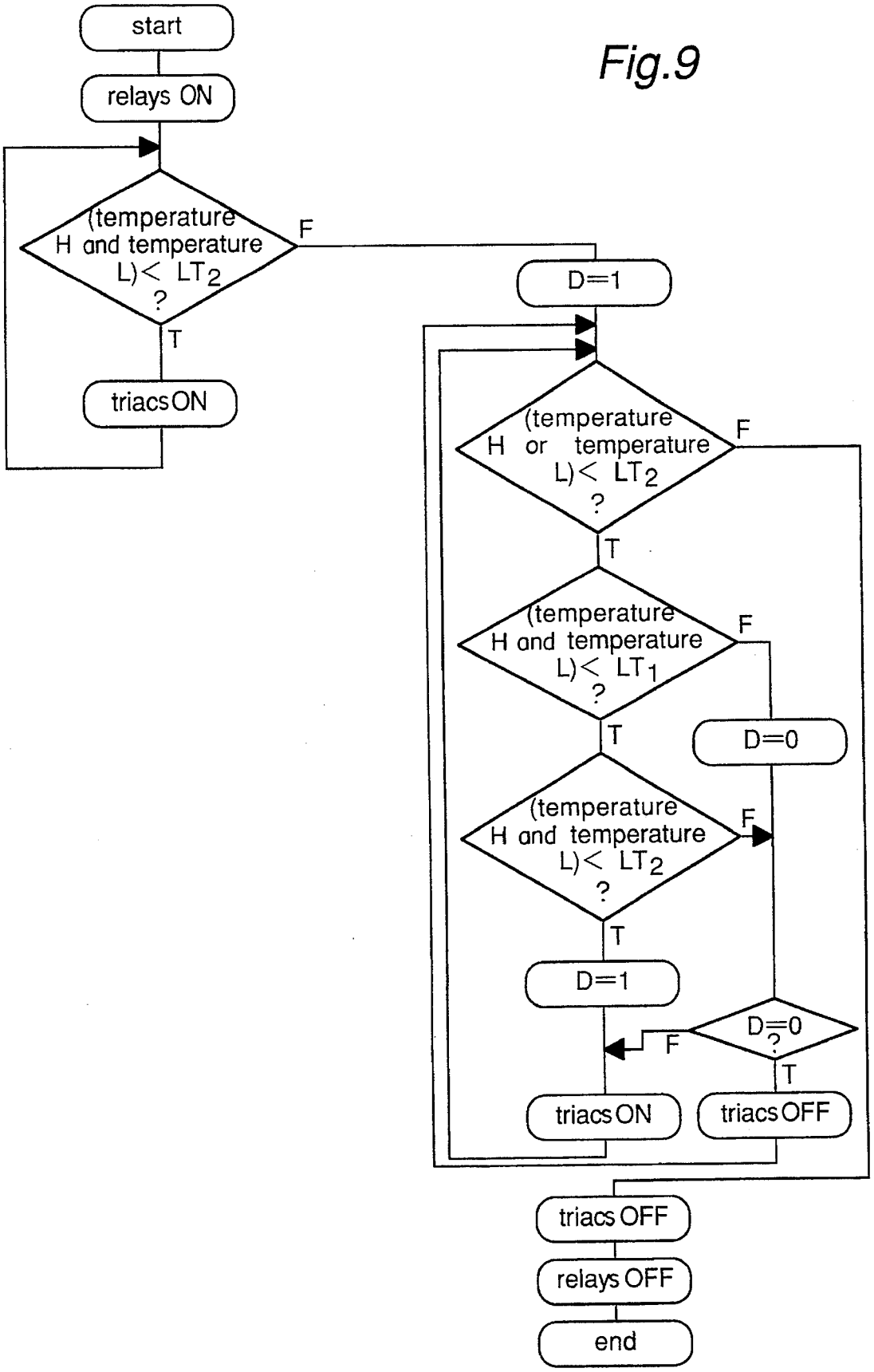
FIG. 9 is a flowchart in a conventional embodiment.
Figure 10A:
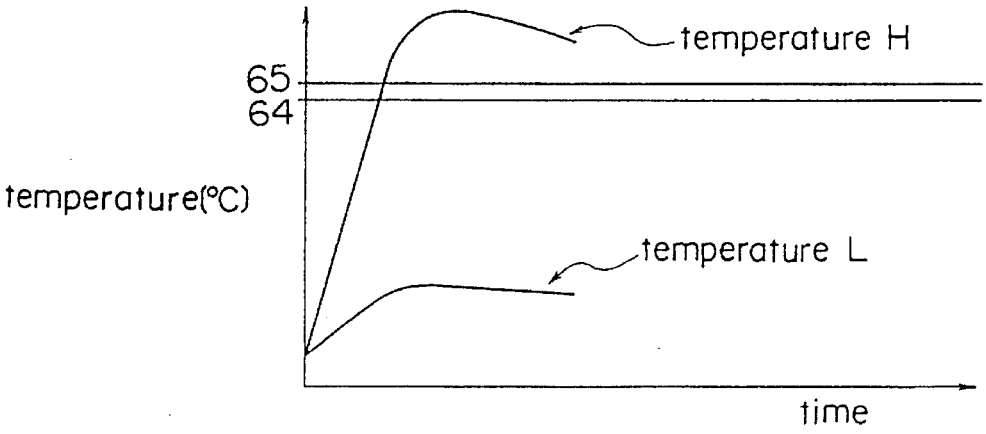
FIG. 10*a*, FIG. 10*b* and FIG. 10*c* are graphs illustrating graphs showing the temperature rise of the food.
Figure 10B:
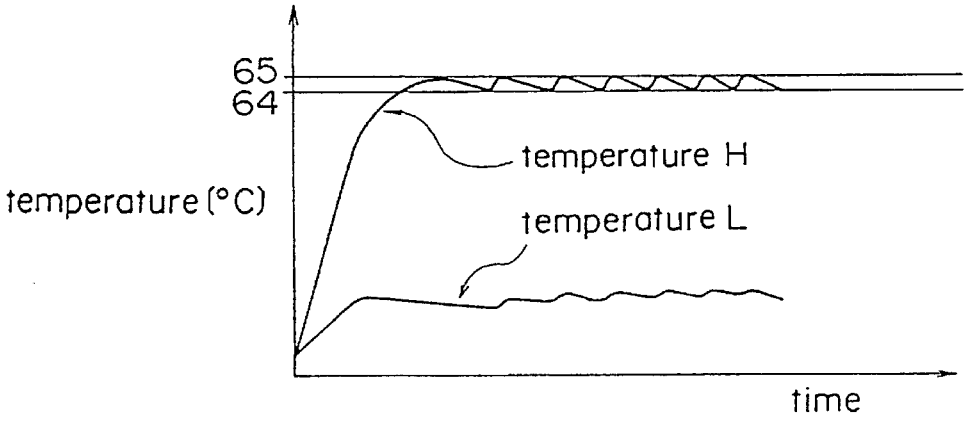
Figure 10C:
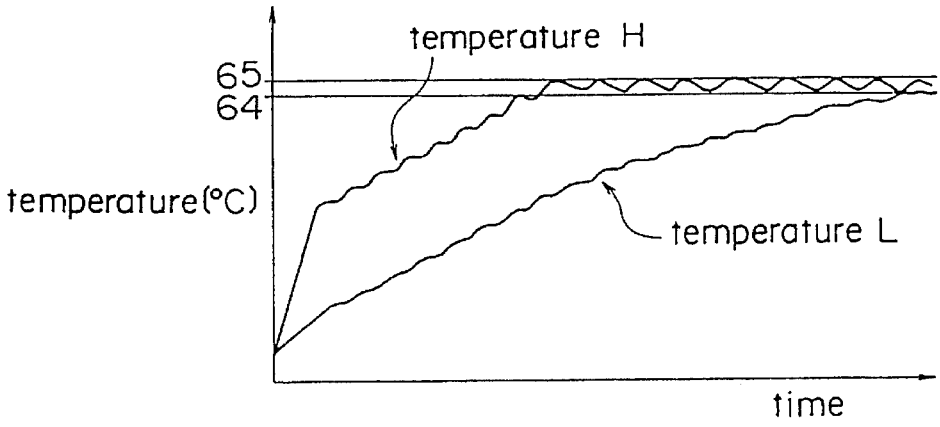
Figure 11A:
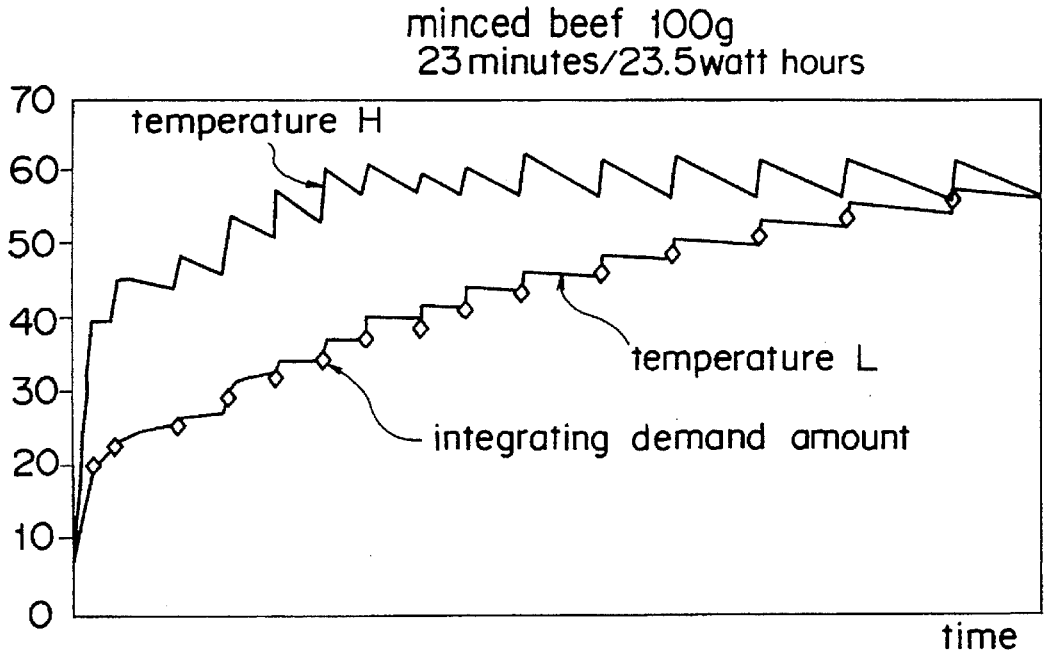
FIG. 11*a*, FIG. 11*b*, FIG. 11*c* and FIG. 11*d* are graphs showing the temperature rise of a food to be heated by the high frequency heating apparatus of the present invention.
Figure 11B:
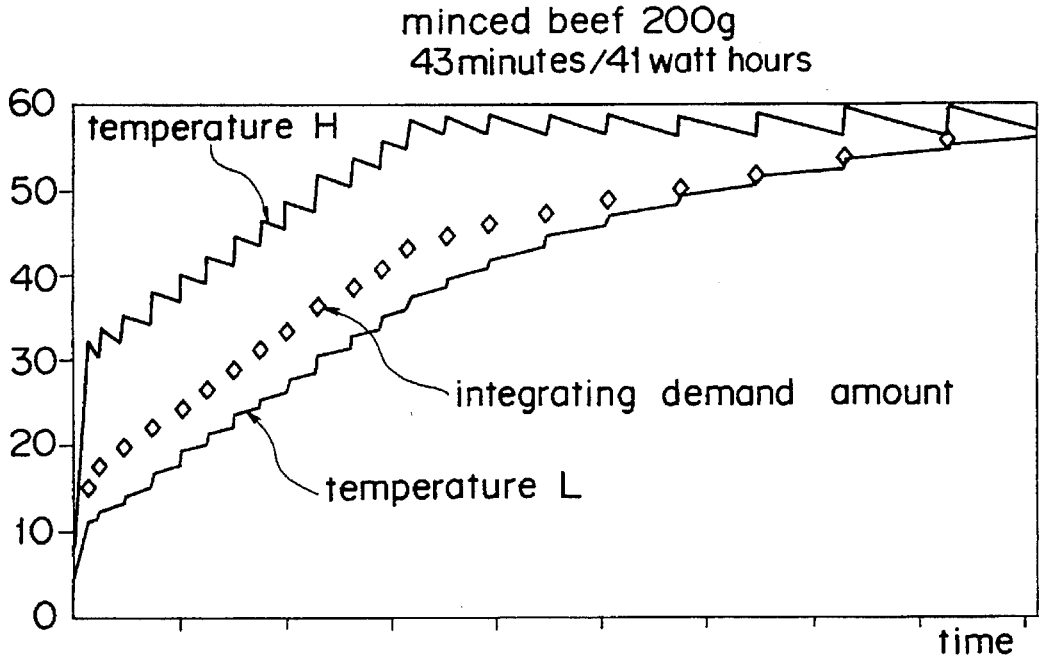
Figure 11C:
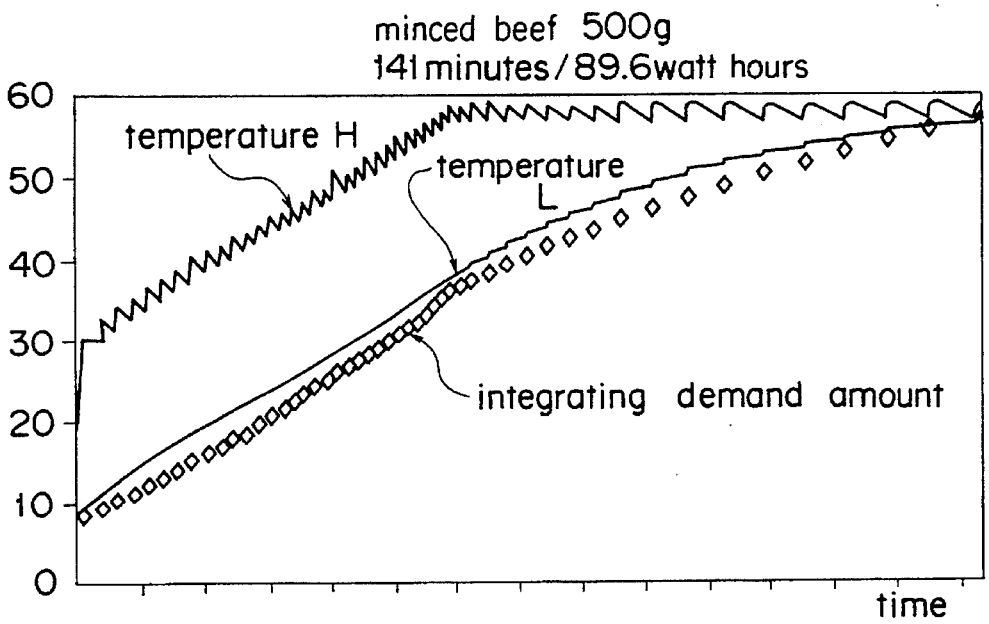
Figure 11D:
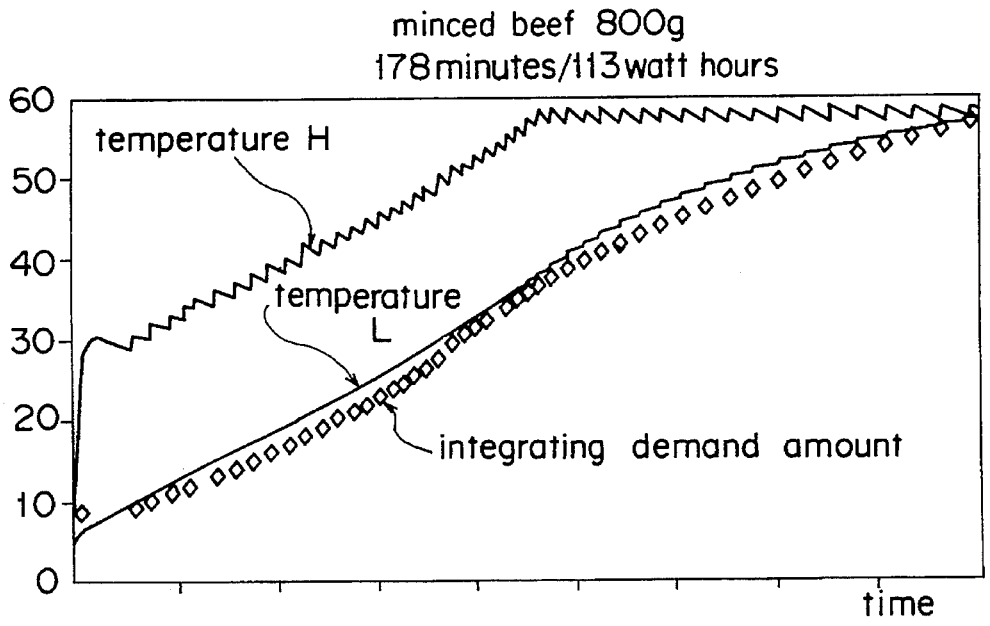

By removing step S3 from the program flow of, for example, FIG. 7, results in a simplified program as shown in FIG. 9. Heat with such a program and the result exceeds 65° C. as shown in FIG. 10 (*a*). Stop the high frequency irradiation at a time point where the temperature H has been reached, for example, approximately 40° C. and the excessive temperature portion can be prevented. The temperature L does not rise. The highest temperature portion does not exceed 65° C. while lowest temperature portion is hardly heated as shown in FIG. 10 (*b*). Irradiate the high frequency waves only when the difference between the temperature H and the temperature L is within, for example, 20° C., and a uniform heating operation within 1° C. in difference with respect to the desired finish temperature $LT_1$ can be effected as shown in FIG. 10 (*c*) or FIG. 8.

The reasons why favorable results can be obtained when the controlling operation of 20° C. is effected are noted below.

Generally, it can be estimated that the specific heat of the pork is approximately 0.35, and specific heat of the salad oil is approximately 0.4. The total heat quantity of both is equivalent to that of approximately 715 cc of water. The heat quantity necessary for raising it from 5° C. to 65° C. is 42,900 calories. Divide it and it becomes 49.8 watt hours in conversion to electric energy. A ratio, to be absorbed into the heated food as high frequency waves, of the integrating electrical energy on the primary side of the above described transformers 68 and 69 is approximately 53% by an appliance used for experiments. The value 136 is multiplied by 0.53 and 72.0 watt hours is considered to be the high frequency wave application power quantity. Therefore, 49.8 / 72= 69.1. Namely, a little over 30% of the energy is lost. The remaining energy can be interpreted to have been absorbed by the heated food.

The food is cooked in a vacuum by a steam oven and the 900 grams of pork is heated to 65° C. in approximately two hours to two and a half hours although it depends upon the set temperature of the oven. The temperature rise by the steam oven is described together with FIG. 8. An integrated power of the above described 136 watt hours is described similarly in FIG. 8.

It can be understood that it is on a curve line the integrated power approximately conforms to a temperature L which is the lowest temperature portion of the pork. In order to confirm whether or not the agreement between the time change of the integrated power and the temperature L is universal, other food, e.g.—minced pork, is formed into a meat loaf and further packed in a vacuum. They are heated likewise in four weights from 100 grams to 800 grams (which are surrounded between two sheets of the same oil mats and are heated up to 58° C. using the program of FIG. 7). The results thereof are shown in FIGS. 11(*a*)–11(*d*). From the results, the phenomena is considered to be universal.

Figure 12:
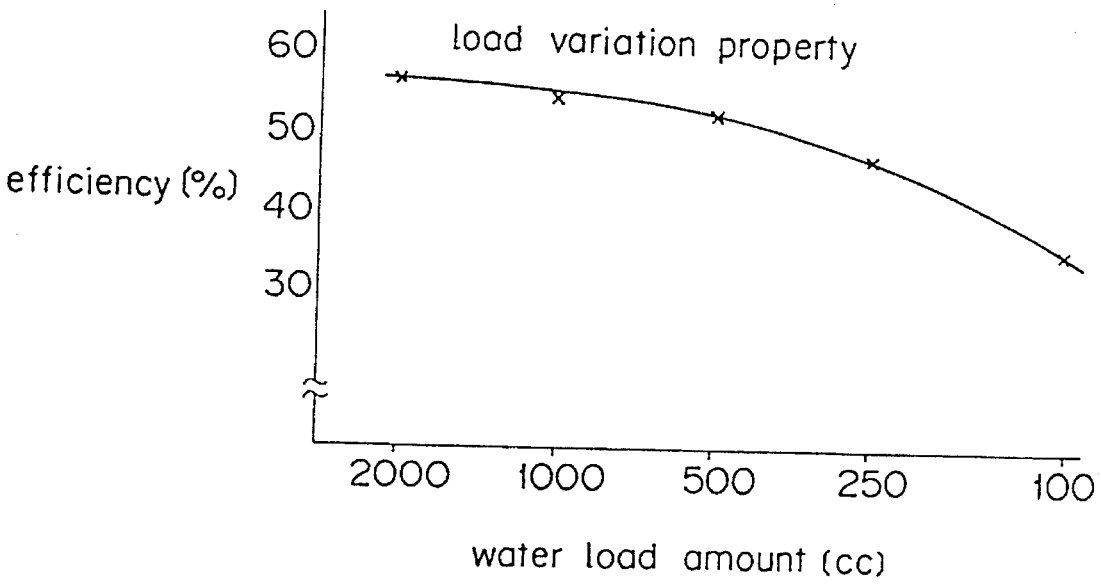
FIG. 12 is a load variation characteristic graph of the high frequency heating apparatus of the present invention.

Table 1 shows the relationship between input power (integrated power) in the above described heating operation and the absorbed heat of the heated food. FIG. 12 shows the load fluctuation characteristics of the high frequency heating apparatus output used for the calculation.

TABLE 1

| | Minced Beef | | | | Pork |
|---|---|---|---|---|---|
| Quality/Weight | 100 g | 200 g | 500 g | 800 g | 900 g |
| Temperature [°C.] | 5→58 | 5→58 | 5→58 | 5→58 | 5→65 |
| 1. Heat quantity of meat, oil mat | 29.8 wh | 32.7 wh | 41.4 wh | 50.1 wh | 49.8 wh |
| 2. Heat quantity of water equivalent to meat | 6.1 wh | 12.3 wh | 30.8 wh | 49.3 wh | 62.7 wh |
| 3. Irradiation power quantity | 23.5 wh | 41 wh | 89.6 wh | 113 wh | 136 wh |
| 4. Corrected value of the above | 7.9 wh | 18.0 wh | 46.5 wh | 59.8 wh | 70.7 wh |
| 2/4 | 77% | 68% | 66% | 82% | 88% |

Calculation is effected as described hereinabove with the specific heat of the beef as approximately 0.43 so as to obtain the (1) line of Table 1. In 100 grams, a value becomes larger than the input power of the (3) line. The (2) line shows the heat amount of the water equivalent in weight to meat. It is assumed to be an absorption heat amount. The value is adopted, because an approximately similar tendency is provided (a description has been omitted) when the oil mat is not used. The irradiation (input) power of the (3) line is a value on the primary side of the transformer as described hereinabove. In order to convert it into the high frequency wave irradiated into the heating chamber, it is converted into the high frequency output amount using the fluctuation characteristics, namely, efficiency characteristics with respect to the water load amount of the high frequency heating apparatus output shown in FIG. 12, thus resulting in the line (4). The ratio of the amount of line (2) divided by the amount of line (4) is between 66% and 88%.

Apply, with high frequency waves, an amount of heat which is approximately 25% more than necessary to raise the amount of water which is the same in weight as the heated food to the desired final temperature, with the time distribution along the temperature rise curve of the central portion, for the time necessary for cooking in vacuum with a steam oven, and a uniform heating operation which is approximately same in extent as that of the steam oven can be effected. The above described temperature difference 20° C. control introduction is considered to have the time distribution closer to that in the steam oven. The uniform heating operation equivalent to the steam oven can be realized by the time distribution of the necessary minimum high frequency energies, along the rule of the heat conduction, by the positive use of the heat conduction of the heated food interior.

When the 20° C. controlling operation is not introduced, it is considered that the irradiated energies are consumed except for the heat conduction of the heated food interior. For example, the heat of the surface portion which is excessively heated is emitted into air. The heat is hardly conducted into the interior of the food.

The temperature rise in a boiled bath and a steam oven is said to be in accordance with the following type of exponential function. Assume that the heated food is an infinite plate or ball. It is solved in accordance with a heat conduction rule, and time t is restricted to a sufficiently large range. It is simplified.

$$(\Theta_w-\Theta)/(\Theta_w-\Theta_o)=exp(-kt) \quad (1)$$

where $\Theta_w$: inside temperature of hot water of a boiled bath or a steam oven $\Theta$: inside temperature of the food $\Theta_o$: initial temperature of the food k : proportional constant (which is different in boiled bath and steam oven)

t : time after heating has started

Figure 13:
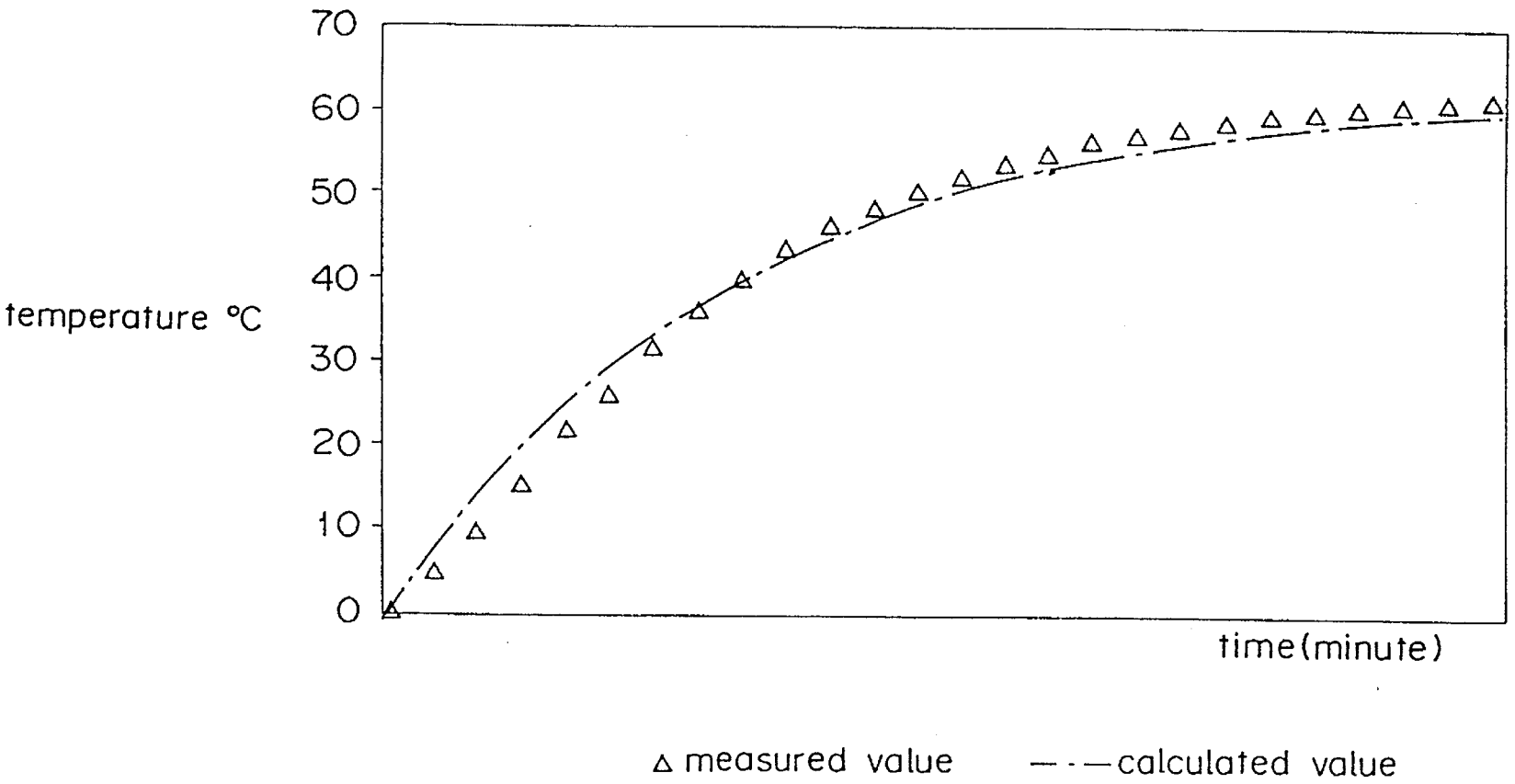
FIG. 13 is a comparison graph between an exponential function and an experiment result.

FIG. 13 is a graph where the rise of the measured inside temperature, represented by the triangles, when the above described 900 grams of pork has been cooked in a vacuum by a steam oven is compared with a dotted curve line where the proper value of k has been substituted into the above described equation. They almost conform although an error exists somewhat at the early heating stage.

In a high frequency heating method for heating a material by a high frequency wave irradiation source, the ratio of the actual cumulated power q to the total calculated cumulated power Q necessary to heat the material up to a desired temperature is given by the following equation:

$$q/Q=1-exp[(t/\tau)*1n(\Delta\theta/\theta)]$$

in which t is time and $\tau$ is the desired total heating time and $\Delta\theta$ is a temperature inclincation inside the material and $\theta$ is a rise temperature which is a difference between the temperature before heating and the desired temperature.

Figure 14:
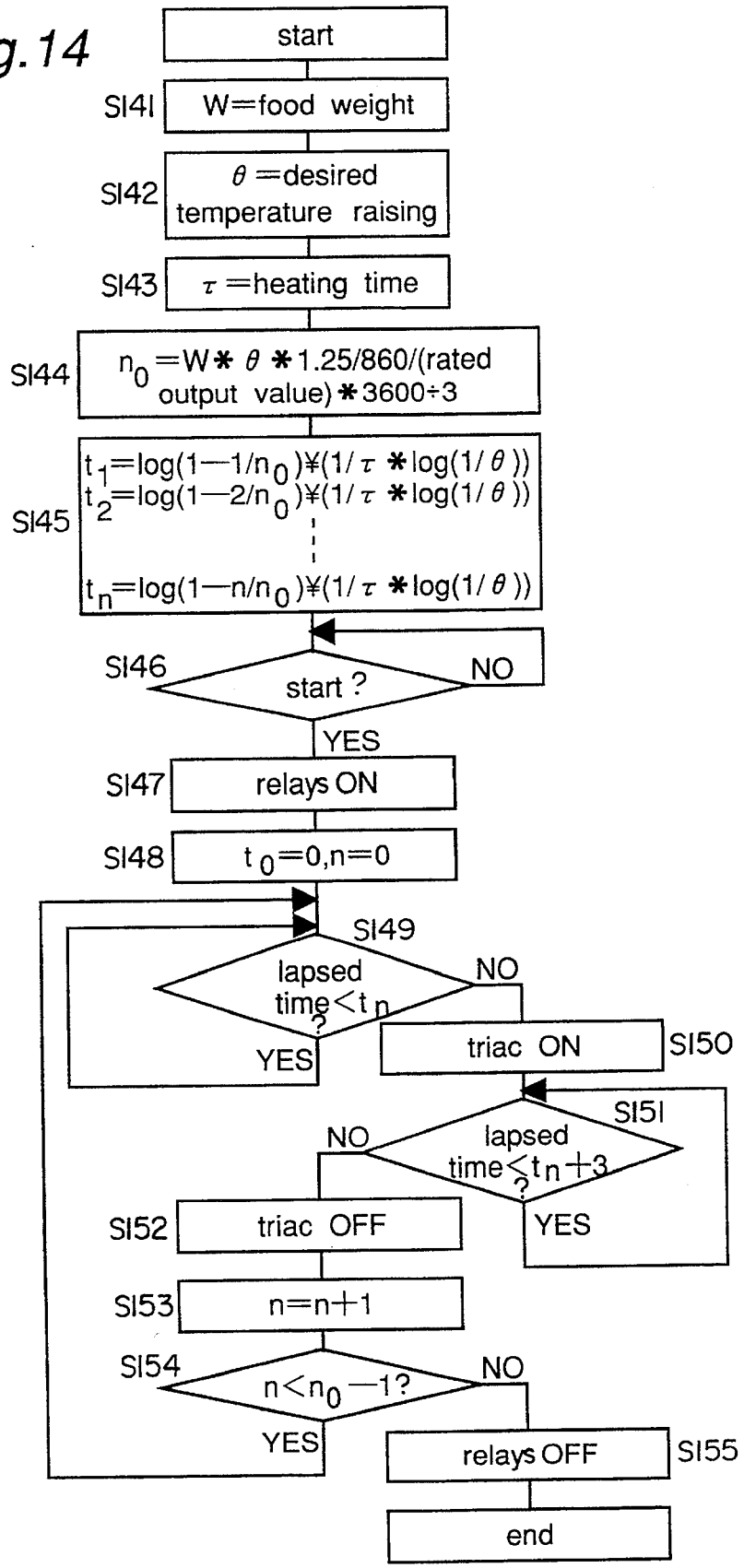
FIG. 14 is a flowchart of the present invention.

If the heat amount (high frequency irradiation power amount) distribution along the above described curve is effected without the use of the optical fiber thermometer, it is considered that the average, equal heating operation of the boiling bath and the steam oven can be realized. FIG. 14 illustrates the control program flow.

The control program flow of FIG. 14 is applicable to a high frequency heating apparatus having circuits where an optical fiber thermometer is omitted from the electric circuit diagram of FIG. 6. When the program is started, the weight of the food (which is assumed to be w in step S141), the desired final temperature rise (a value where an initial temperature $\Theta_o$ is subtracted from the desired final temperature $\Theta_1$ of the food is assumed to be $\theta$ in step S142) and a heating time (which is assumed to be T in step S143) needed for the temperature rise are inputted into a personal computer 90. The calculating operation is then effected (basic is basically used in expression). A desired temperature rise value $\theta$ is multiplied by food weight w. It is multiplied by 1.25 in anticipation of the above described 25 % loss. It is divided by 860 for conversion into the power amount. The high frequency power amount to be irradiated into the hating chamber can be calculated by the calculation provided so far.

In effecting the time distribution in accordance with the above described exponential function, the heating is realized by the combination of short time irradiation and no irradiation using software, because an appliance capable of variable power adjustments is very difficult to make in terms of hardware. It is divided by nominal high frequency output value (rated output value) for calculation of the irradiation total time and is multiplied by 3,600 seconds in step S144. The irradiation time is made constantly 3 seconds where favorable results are obtained by experiments. It is divided by 3 and the fractions are omitted. The total number of three second irradiations $n_0$ is thus obtained in step S144.

In order to assign the $n_o$ frequency to the time $\tau$ in accordance with the exponential function (1), the time required to reach to a temperature lower by 1° C. than the desired temperature is substituted for $\tau$, $$\text{first time} \quad t1 = \log(1-1/n_0) \div (1/\tau * \log(1/\theta))$$

$$\text{nth time} \quad t_n = \log(1-n/n_0) \div (1/\tau * \log(1/\theta))$$

The $(n_o-1)^{th}$ time is obtained and stored in step S145.

The food is put into the heating chamber in this condition. When it has been determined that the start key has been depressed in step S146, first, a relay is turned on in step S147 and then $t_o$ is set to 0 and the number counter is set to n =O in step S148. A determination is made in step S149 as to the time from the depression of the start key so as to confirm that the time period has not reached $\tau$ time shown in the number counter. Although the time period is 0 immediately after the start, as the $t_o$ time is also set to 0, the program advances to step S150 so as to turn on a triode AC switch. A determination is made in step S151 that the time period has not reached $t_n$+ 3 seconds. When the time period reaches the time $t_n$+ 3, the program proceeds to step S152 so as to turn on the triode AC switch OFF. The number n of the time counter 1 is advance din step S153. A determination is then made in step S154 as to whether n< $n_o$ −1. If so, the program returns to sep S149 and the loop is repeated until n= $n_o$−1. At that time, the program proceeds to step S155 in which the relay is turned OFF and the program ends.

A heating operation is effected using the control program. As a result, the temperature difference of the interior of the food is small and the temperature of the food varies each time. Change the above described loss 25% like, for example, 15% or 35% using the same food as in material quality and shape so as to repeat trial and error often and the temperature becomes closer to the desired temperature. But it is difficult to stably have a difference within 1° C.

In order to obtain the stable result, a method of controlling high frequency irradiation amount while monitoring the temperature of the food is required. The thermistor 43 within the wire rack 17 is provided for monitoring the temperature.

Figure 15:
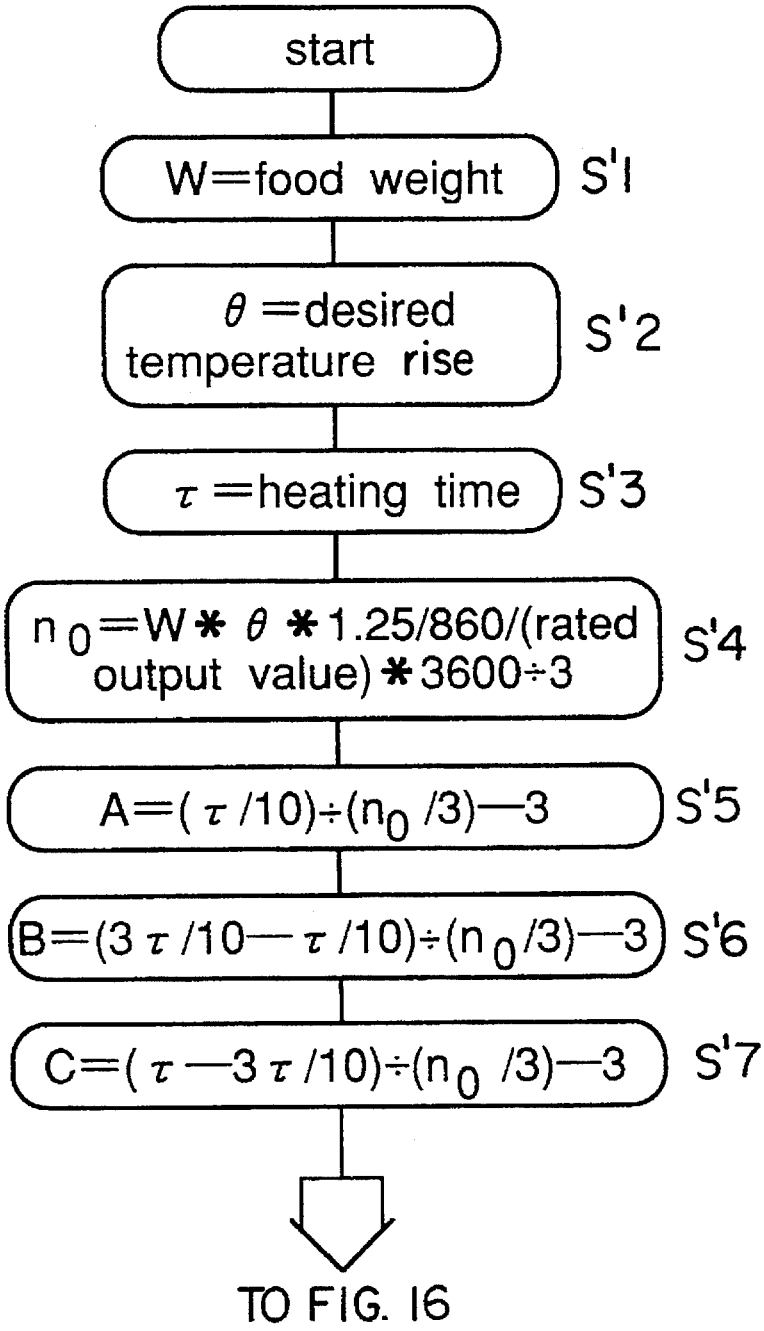
FIG. 15 is a flowchart in accordance with still another embodiment of the present invention.

In the above described heating flow operation of FIG. 14, the high frequency irradiation amount is distributed in time along the exponential function (1), namely, a curved line. In order to control the high frequency irradiation, the curved line is approximated by a plurality of straight line segments, for example, about three straight line segments and the temperature in the intersecting points of the straight lines is monitored so that the controlling operation is easy to effect. The curved line is approximated with three straight line segments with FIG. 10 as a reference. As the exponential function passes one tenth of the heating time and approximately one third of the temperature rise i.e.

$$\left(\frac{\tau}{10} \text{ and } \frac{\Theta}{3}\right)$$

and a second point of three tenths of the heating time and approximately two thirds of the temperature rise, i.e.

$$\left(\frac{3}{10}\tau \text{ and } \frac{2}{3}\Theta\right)$$

there are three straight lines with two intersecting points. In the respective straight lines, the high frequency irradiation time is all three seconds and the irradiations stop time is respectively A, B or C seconds. A method of deciding these constants will be described with the flowchart of FIG. 15. The steps S'1–S'4 are the same as steps S141–S144 of FIG. 14. Then, a value A is obtained in step S'5 by dividing $\tau/10$ by $n_o$ /3 and thereafter, three seconds are subtracted. Similarly, the value B is obtained in step S'6 by dividing $$\left(\frac{3}{10}\tau - \frac{\tau}{10}\right)$$

by ($^{no}$/3) and thereafter, three seconds are subtracted. The value C is obtained in step S'7 by dividing ($\tau$-3$\tau$ / 10) by $n_o$/3 and thereafter, three seconds are subtracted. The program then advances to FIG. 16.

Figure 16:
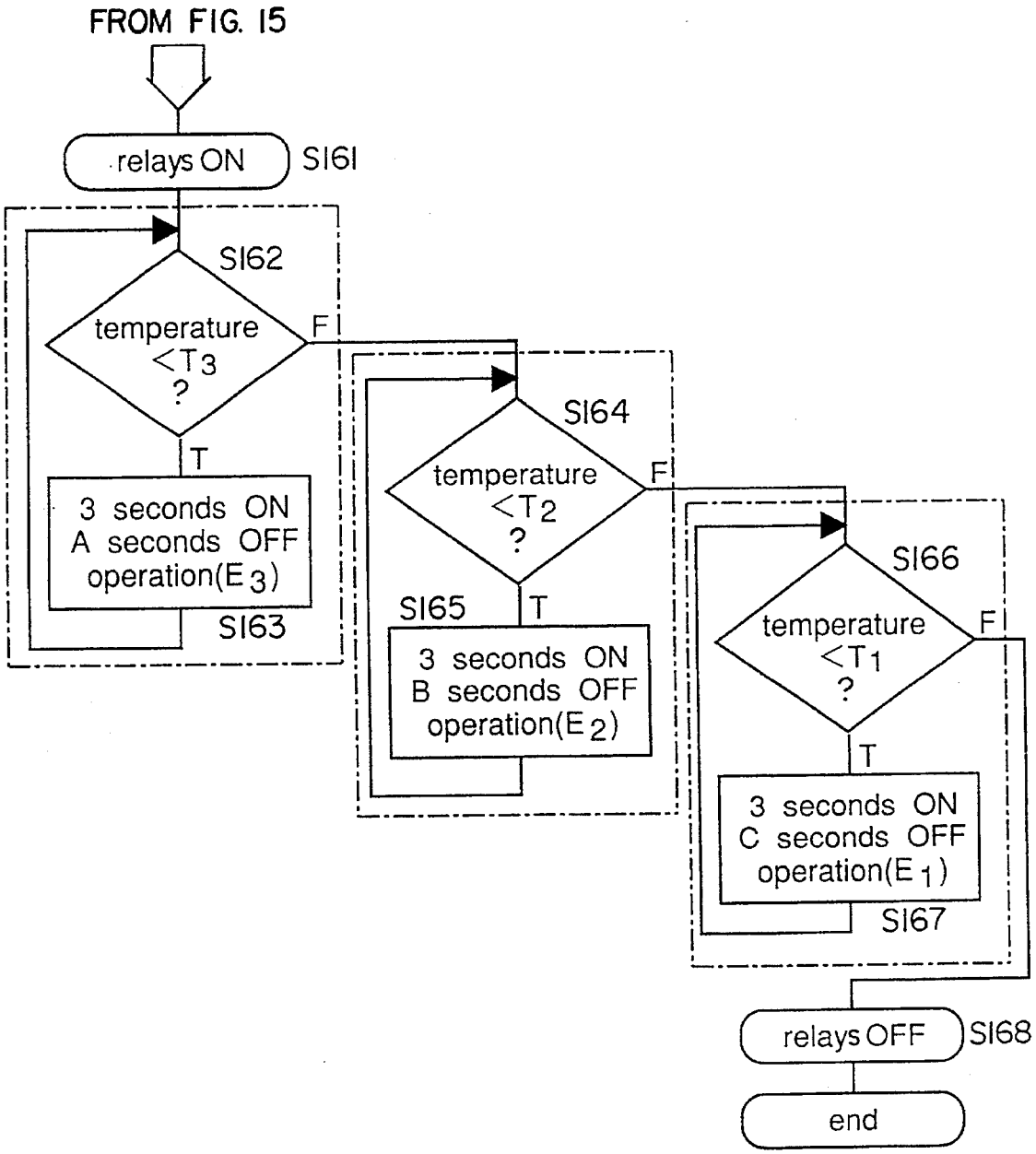
FIG. 16 is a flowchart in accordance with a further embodiment of the present invention.

FIG. 16 is a flowchart of a control program after the start key has been depressed. In step S161, all of the relays are turned ON. In step S162 a determination is made that the output value (voltage value of the thermistor 43 provided in the wire rack 17) of the food surface temperature detecting means has not reached the temperature. Periodic operations (which are assume to be high frequency energies of $E_3$ per unit time) of three seconds on and A seconds off are continuously repeated in step S163. A true determination means that the temperature is a value where the initial value $T_o$ (before the heating) of the food has been subtracted from the output value $T_1$ when the heated food whose temperature reaching the final temperature $\Theta_1$ is measured by the food surface temperature detecting means 43. The program advances to step S164 after the output value has reached $T_3$. In step 164, a determination is made that the temperature has not reached $T_2$ this time, and a periodic operation (which is assumed to be high frequency energies of $E_2$ per unit time) of three seconds on and B seconds off is continuously repeated in step S165. After the temperature it has reached $T_2$, the program advances to step S166. In steps S166, a determination is made that the temperature has not reached $T_1$, and a periodic operation (likewise, E1) of three seconds on and C seconds off are continuously repeated in step S167. After the temperature has reached $T_1$, the program advances to step S168. All of the relays are turned off in step S168 so as to end the program.

The difference 1° C. or lower with respect to the desired temperature is stably obtained as in a case where a optical fiber shown in FIG. 6 is used when a cooking operation is effected by a method of the sectional view shown in FIG. 1 using the control program by the flow.

As is clear from the foregoing description, according to the arrangement of the present invention, the uniform heating operation of approximately 1° C. in temperature difference can be realized, and considerable fuel cost reduction can be effected and also, operation environment can be large improved as compared with a vacuum cooking operation using the conventional boiling bath and the steam oven.

Although the present invention has been fully described by way of example with reference to the accompanying drawings, it is to be noted here that various changes and modifications will be apparent to those skilled in the art. Therefore, unless otherwise such changes and modifications depart from the scope of the present inventions, they should be construed as being included therein.

What is claimed is:

1. A high frequency heating apparatus for heating a material, said apparatus comprising:

a heating chamber for accommodating said material; a high frequency wave irradiation source for irradiating high frequency waves into said heating chamber;

a desired temperature setter for setting a desired temperature to which said material is to be heated;

a threshold temperature setter for setting a threshold temperature which is lower than said desired temperature;

a surface temperature detector for detecting a temperatures of a surface portion of said material;

a center temperature detector for detecting a temperature of a center portion of said material;

a calculator for calculating a difference between said surface temperature and said center temperature and for producing a difference temperature; and a controller for controlling said irradiation source such that said irradiation source irradiates high frequency waves when the following three conditions are satisfied;

(i) said difference temperature is within a predetermined set range;

(ii) said surface temperature is less than said desired temperature; and (iii) said center temperature is less than said threshold temperature.

2. A high frequency heating apparatus as claimed in claim 1, wherein said threshold temperature is at least 1° C. below said desired temperature.

3. A high frequency heating apparatus as claimed in claim 1, wherein said desired temperature is on the order of 65° C.

4. A high frequency heating apparatus as claimed in claim 1, wherein said predetermined set range is on the order of 20° C.

5. A high frequency heating apparatus as claimed in claim 1, wherein each of said surface temperature detectors and said center temperature detector comprise an optical fiber thermometer.

6. A high frequency heating method for heating a material by a high frequency wave irradiation source, comprising the steps of:

(a) detecting both a temperature of a surface portion of said material and a temperature of a center portion of said material;

(b) detecting a difference between said surface temperature and said center temperature and producing a difference temperature; and (c) irradiating high frequency waves by said irradiation source when the following three conditions are satisfied:

(i) said difference temperature is within a predetermined set range;

(ii) said surface temperature is less than a desired temperature to which said material is to be heated; and (iii) said center temperature is less than a threshold temperature which is lower than said desired temperature.

7. A high frequency heating method as claimed in claim 6, wherein said threshold temperature is at least 1° C. below said desired temperature.

8. A high frequency heating method as claimed in claim 6, wherein said desired temperature is on the order of 65° C.

9. A high frequency heating method as claimed in claim 6, wherein said predetermined set range is on the order of 20° C.

10. A high frequency heating apparatus for heating a material, said apparatus comprising:

a heating chamber for accommodating said material;

a high frequency wave irradiation source for irradiating high frequency waves into said heating chamber;

a temperature detector for detecting a current temperature of said material;

a weight setter for setting a weight W of said material;

a desired temperature setter for setting a desired temperature to which said material is to be heated and for obtaining a rise temperature θ which is a difference between said current temperature before heating and said desired temperature;

a heating time setter for setting a desired total heating time τ;

a total cumulated power calculator for calculating, based on said weight and said rise temperature, a total cumulated power Q necessary to heat said material up to said desired temperature;

an irradiation source controller for controlling said irradiation source such that a cumulated power q from said irradiation source increases exponentially until said cumulated power reaches said total cumulated power.

11. A high frequency heating apparatus as claimed in claim 10, wherein said irradiation source controller controls said irradiation source such that said cumulated power q is given by a following equation:

$$q/Q=1-exp[(t/\tau)*1n(\Delta\theta/\theta)]$$

in which t is time and Δθ is a temperature inclination inside said material.

12. A high frequency heating apparatus as claimed in claim 10, wherein said irradiation source controller controls said irradiation source such that said cumulated power q increases along an approximation line defined by a plurality of line segments so connected as to represent an approximation of said exponential increase.

13. A high frequency heating apparatus as claimed in claim 12, wherein said approximation line is defined by first, second and third line segments, said first line segment extending from an origin to a first intermediate point with a first inclination, said second line segment extending from said first intermediate point to a second intermediate point with a second inclination which is smaller than said first inclination, and said third line segment extending from said second intermediate point to a terminal point which is at said total heating time $\tau$ and said total cumulated power Q.

14. high frequency heating apparatus as claimed in claim 10, wherein until the current temperature of said material detected by said temperature detector reaches a specified value, periodic operations of specified time periods of high frequency energies of on and off are intermittently repeated.

15. A high frequency heating method for heating a material by a high frequency wave irradiation source, comprising the steps of:

(a) detecting a current temperature of said material;

(b) detecting a weight W of said material;

(c) setting a desired temperature to which said material is to be heated and for obtaining a rise temperature $\theta$ which is a difference between said current temperature before heating and said desired temperature;

(d) setting a desired total heating time $\tau$;

(e) calculating, based on said weight and said rise temperature, a total cumulated power Q necessary to heat said material up to said desired temperature; and (f) controlling said irradiation source such that a cumulated power q from said irradiation source increases exponentially until said cumulated power reaches said total cumulated power.

16. A high frequency heating method as claimed in claim 15, wherein said step (f) controls said irradiation source such that said cumulated power q is given by the following equation:

$$q/Q=1\text{-}exp[(t/\tau)*1n(\Delta\theta/\theta)].$$

in which t is time and $\Delta\theta$ is a temperature inclination inside said material.

17. A high frequency heating method claimed in claim 15, wherein said step (f) controls said irradiation source such that said cumulated power q increases along an approximation line defined by a plurality of line segments so connected as to represent an approximation of said exponential increase.

18. A high frequency heating method as claimed in claim 17, wherein said approximation line is defined by first, second, and third line segments, said first line segment extending form an origin to a first intermediate point with a first inclination, said second line segment extending from said first intermediate point to a second intermediate point with a second inclination which is smaller than said first inclination, and said third line segment extending from said second intermediate point to a terminal point which is at said total heating time T and said total cumulated power Q.

* * * * *